United States Patent [19]

Sato et al.

[11] Patent Number: 4,798,525

[45] Date of Patent: Jan. 17, 1989

[54] CASTING INSTALLATION

[75] Inventors: Kimiteru Sato; Haruyuki Ito, both of Kitakyushu, Japan

[73] Assignee: Toto Ltd., Kitakyushu, Japan

[21] Appl. No.: 81,748

[22] Filed: Aug. 5, 1987

[30] Foreign Application Priority Data

Aug. 8, 1986 [JP] Japan ..... 61-186242

[51] Int. Cl.[4] ..... B28B 1/26

[52] U.S. Cl. ..... 425/84; 249/137; 249/141; 264/86; 425/85; 425/435; 425/451.9

[58] Field of Search ..... 249/65, 137, 141, 160; 264/86, 87; 425/73, 84, 85, 86, 215, 405 R, 435, 450.1, 451.9, DIG. 112

[56] References Cited

U.S. PATENT DOCUMENTS

| | | | |
|---|---|---|---|
| 3,243,860 | 4/1966 | Whittaker et al. | 425/84 |
| 3,431,332 | 3/1969 | Cummings | 264/86 |
| 3,717,430 | 2/1973 | Hansen | 425/450.1 |
| 4,043,737 | 8/1977 | Greenberg | 425/450.1 |
| 4,664,610 | 5/1987 | Aoyama et al. | 425/85 |

FOREIGN PATENT DOCUMENTS

| | | |
|---|---|---|
| 56-14451 | 4/1981 | Japan . |
| 58-17811 | 4/1983 | Japan . |
| 58-208005 | 12/1983 | Japan . |
| 60-8010 | 1/1985 | Japan . |
| 1295055 | 11/1972 | United Kingdom . |

*Primary Examiner*—Jay H. Woo
*Assistant Examiner*—C. Scott Bushey
*Attorney, Agent, or Firm*—Fleit, Jacobson, Cohn & Price

[57] ABSTRACT

A casting installation for casting slip into ceramic product by use of at least one unique casting mold. The casting mold is formed of a plurality of separate mold parts each having a plurality of channels therein and having its respective outer face treated to be fluid-tight and inner molding surface. The casting installation includes a pressure-resisting container having a surrounding wall formed along the inner surface thereof so as to define an opening through the container, the mold parts, when assembled, being dimensioned to define a molding cavity of the casting mold; the space being in communication with the molding cavity of the mold. The casting installation further includes a clamp for clamping the casting mold firmly; the channels are operatively connected for depressurizing the channels; a source of slip operatively connected to the molding cavity of the casting mold; and a source of fluid operatively connected to the space surrounding the casting mold.

16 Claims, 4 Drawing Sheets

CASTING INSTALLATION

BACKGROUND OF THE INVENTION

1. Field of the Invention

The present invention relates to a casting installation for casting slip into ceramic products such as sanitaryware, water tanks, tiles, porcelain plates and pipes, gravestones or the like.

2. Description of the Prior Art

In the prior art slip casting techniques, slip is introduced under a pressure in the range of 3 to 20 kg/cm$^2$ into a pressure-resisting porous casting mold so that the water content of the slip may be extruded under the action of that pressure through the interface between the inner molding surface of the mold and the slip, via the thickness of the porous mold and eventually to the outside of the mold. This casting operation is continued until the slip in the region of the molding surface is dehydrated to deposit into a layer of a predetermined thickness. On attaining the predetermined thickness of the cast slip layer on the interior surface of the casting mold, the casting mold is rotated or inclined while being fed with compressed air (under a pressure within the range of about 1 to 2 kg/cm$^2$) for forcibly discharging the residual slip out of the mold via a slip discharge port in the mold. After this discharging, the discharge port is closed, and additional compressed air is fed into the mold to provide further dehydration or reduction in the water content of the slip cast layer.

The main disadvantage of the prior slip casting techniques is that the casting mold requires high pressure resistance sufficient to withstand the relatively high pressure under which the slip is being introduced thereinto, which can result in costly and time-consuming production of the casting mold.

Furthermore, the casting installation as well must be durable and heavy, which would degrade its profitability.

SUMMARY OF THE INVENTION

With the defects of the prior art technique in mind, therefore, an object of the present invention is to provide a casting installation for efficiently casting the slip into a ceramic product by use of a unique lightweight casting mold as is easy to handle but need not have a highly durable pressure-resisting structure.

According to the present invention, there is provided a casting installation for casting slip into a ceramic product, comprising: a pressure-resisting container having a surrounding wall formed along the inner surface thereof so as to define an opening through the container; at least one casting mold adapted to be located in the opening of the container so as to establish a space which surrounds the casting mold, the casting mold being composed of a plurality of separate mold parts each having a plurality of channels therein and having its respective outer face treated to be fluid-tight and inner molding surface, the mold parts, when assembled, being dimensioned to define a molding cavity of the casting mold; the space being in communication with the molding cavity of the mold; means for clamping the casting mold firmly; means operatively connected to the channels of the mold parts for depressurizing the latter; a source of slip operatively connected to the molding cavity of the casting mold; and a source of fluid operatively connected to the space surrounding the casting mold.

In a preferred embodiment of the present invention, the clamping means comprises a plurality of separate inflatable air bladders disposed in the space so that the air bladders, when supplied with compressed air from its source, inflate and engage the outer faces of the mold parts, thereby to clamp the casting mold firmly.

In another embodiment of the present invention, the clamping means includes pneumatic or hydraulic cylinder clamp units.

One or more auxiliary slip supply reservoirs may be connected between the space surrounding the casting mold and the molding cavity thereof for supplying additinal slip to the molding cavity.

Alternatively, the auxiliary slip supply reservoir means comprises a recess in the casting mold.

The fluid source may be either a compressed air source or a pressurized water source.

BRIEF DESCRIPTION OF THE DRAWINGS

Other objects, features and advantages of the present invention will become apparent from the following description when taken with reference to the accompanying drawings, in which.

DESCRIPTION OF THE PREFERRED EMBODIMENTS

Throughout the drawings, for ease of illustration, like elements are identified by like numerals.

Figure 1:
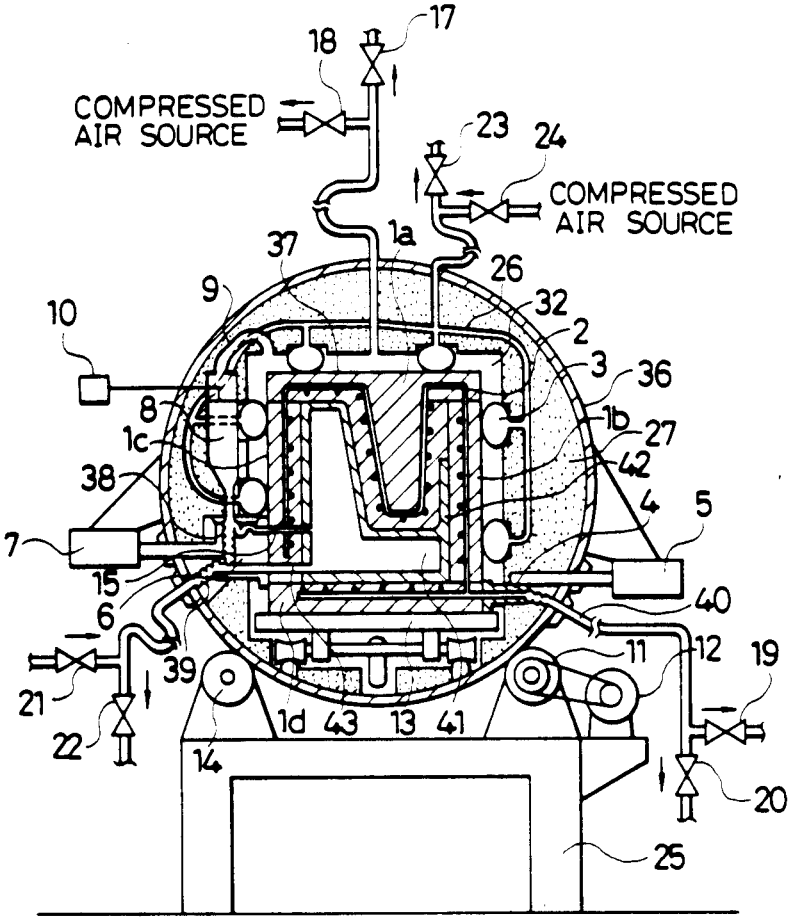
FIGS. 1 and 2 are a partially sectional view and a general perspective view, respectively, showing a casting installation according to the present invention for carrying out a casting process of one embodiment of the present invention.
Figure 2:
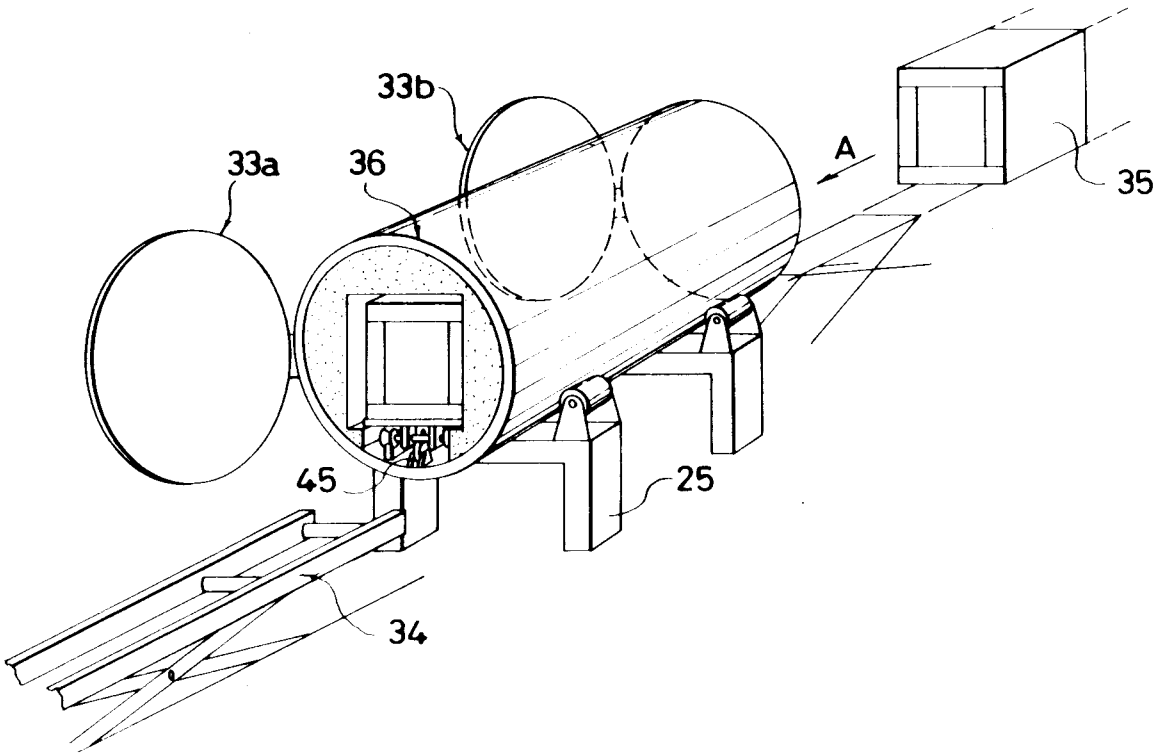

In FIGS. 1 and 2, there is shown a pressure-resisting container 36 according to the present invention preferably made of cylindrical shape in which are located a plurality of rectangular casting molds 1 (only one is shown in FIGS. 1 and 2) which are carried on carrier 13 which may include a roller conveyor, a chain conveyor or the like. The conveyor, if used, may be arrangd to move through the pressure-resisting container 36 and to be provided thereon with pallets for supporting the casting molds 1.

The cylindrical pressure-resisting container 36 is supported for rotation about its longitudinal axis by two sets of rollers 11 and 14 placed on a base 25, with one of which roller sets is associated a motor/reducer unit 12. The controlling of the motor/reducer unit 12 causes the rollers 11 to rotate a predetermined number of turns, which allows the cylindrical container to rotate about its axis by an angle at which the casting molds 1 contained in the container are being brought into its slip discharging position. Accordingly, in other words, the motor/reducer unit 12 causes the casting molds 1 in the container 36 to angularly displace between their upright casting position and include slip discharging position through the rollers 11 and 14.

The casting mold 1 consists of a plurality of parts, of which four parts 1*a*, 1*b*, 1*c* and 1*d* are shown in section in FIG. 1. Each of these mold parts 1a to 1d is preferably of a porous material such as gypsum or other comparable porous material. Each mold part 1*a*, 1*b*, 1*c* or 1*d* has its respective outer face 37 sealingly covered with a resin or the like to prevent any fluid such as air or water from passing therethrough. As shown in FIG. 1, the mold part 1*a*, 1*b*, 1*c* or 1*d* is provided therein with passageways or channels 2 in the form of a hollow pipe arranged in a network pattern (only a portion is shown in FIG. 1). The channels 2 of each mold part also are arranged to communicate with one another and are adapted to be operatively connected to an in-mold pressure-releasing flexible tube 40 extending through a pad 4 which is brought into or out of engagement with the casting mold 1 by the action of a cylinder unit 5. The in-mold pressure-reducing flexible tube 40 also is opened on one hand to the atmosphere through a valve 19 and connected on the other hand to a pressure reducer (not shown) through a valve 20. Alternatively, the passageways 2 of each mold part may be made operatively independent of those of the adjacent mold parts and separately connected to the in-mold pressure-reducing flexible pipe 40.

Each of the casting molds 1 also has a slip admission and discharge port 43 at its respective bottom portion for admitting and discharging the slip therethrough. The slip discharge port 43 of each casting mold is adapted to be operatively connected to a casting and draining flexible tube 39 extending at one end portion through a pad 6 which comes into and out of contact with the casting mold through the action of a cylinder unit 7. The other end of the flexible tube 39 is connected on one hand through a casting valve 21 to a slip source (not shown) and leads on the other hand through a slip discharging valve 22 to a slip reservoir (not shown).

As shown, a surrounding wall 27 is formed in the pressure-resisting container 36 along the cylindrical inner surface thereof so as to define a hollow area which may be rectangular in section in which the casting molds 1 are located with a small space or gap 32 between the inner surface of the wall 27 and the casting molds 1. Preferably, the surrounding wall 27 is formed of light aggregates. The space 32 in the pressure-resisting container 36 is equipped in its selected areas with a plurality of separate inflatable air bladders 3 which can cooperate to clamp the casting molds 1 against their motion. The air bladders 3 are connected with one another via air passageways or conduits 26 which are provided in the surrounding wall 27. These air conduits 26 in turn are connected on one hand to a compressed air source (not shown) through an air feed valve 24 and on the other hand to the atmosphere through an air release valve 23.

In order to reduce the amount of the compressed air to be fed to the air bladders 3 for fully clamping the molds 1, it is advantageous to produce narrower space 32 between the surrounding wall 27 and the outer mold faces 37 for example, by making the surrounding wall 27 more massive within the container 36.

In the present preferred embodiment, as described above, the mold clamping means is composed of the inflatable air bladders 3 which are arranged along the sides of the casting molds 1 in the space 32 in the pressure-resisting container 36. As an alternative to the clamping means, pneumatic or hydraulic cylinder clamp units may be disposed in the pressure-resisting container 36 to clamp the casting molds 1 therearound. On the other hand, rather than subjecting clamping operation to the molds 1 within the presure-resisting container 36 after insertion thereinto, the casting molds may be clamped by any suitable clamping means prior to introduction thereof into the container 36. An aperture in mold port 1*a* provides communication between the recesses 18 and the mold cavity 41.

Further included in the casting installation of the present invention are one or more auxiliary slip supply reservoirs 8 which are disposed outside the casting molds 1 within the surrounding wall 27 of the pressure-resisting container 36. The auxiliary slip supply reservoir 8 is connected at the lower portion thereof to the casting and draining flexible tube 39 through a slip supply flexible tube 38 communicating with a mold cavity 41 via a conduit 15, and at its upper portion to the space 32 via an air conduit 9. With the arrangement described above, it should be noted that the pressure on the slip being cast and the pressure in the space 32 can be substantially equalized.

Figure 3:
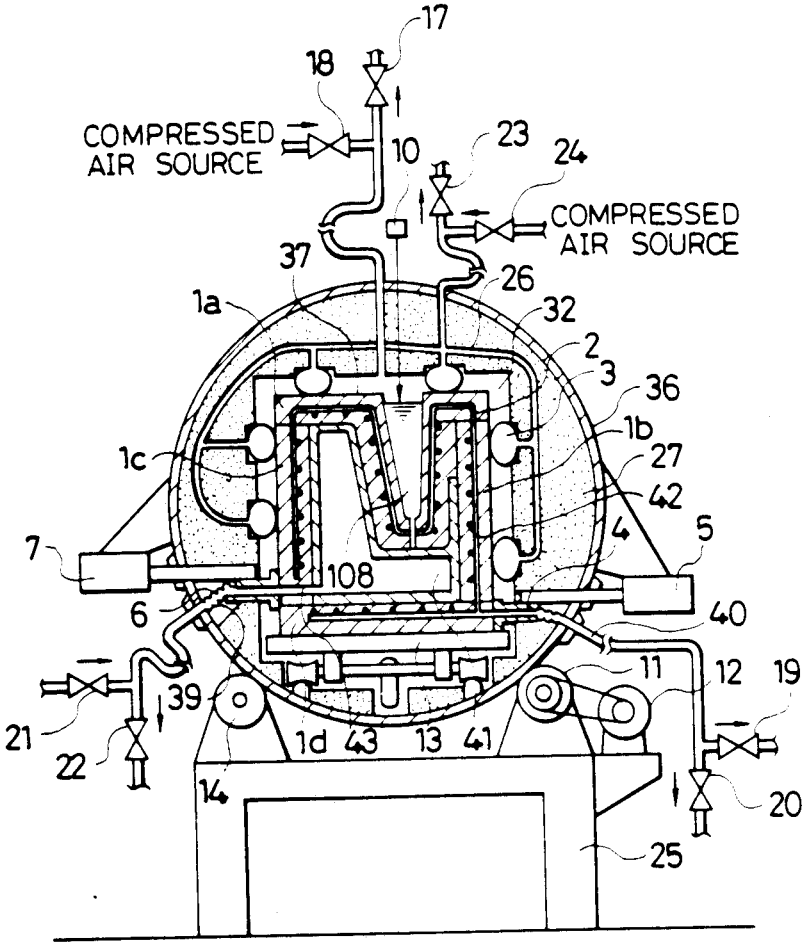
FIG. 3 is similar to FIG. 1, showing a second embodiment of the casting installation.

Alternatively, it is possible to use as auxiliary slip supply means a longitudinal recess 108 provided in any of the mold parts, e.g., 1*a*, of each mold as shown in FIG. 3. Otherwise, the auxiliary slip supply reservoir may be individually disposed outside of the pressure-resisting container 36.

A level controller 10 is associated with the slip supply reservoir 8 and controls the level of the slip within the mold during the casting operation.

In operation, the mold parts are set up to provide a plurality of casting molds 1, and then these molds 1 are conveyed successively one after another into the container 36 at the one end in the direction of arrow A as shown in FIG. 2 until a predetermined number of the molds 1 are disposed therein. The opening of an access door 33*b* at the introduction end of the pressure-resisting container 36 allows such introduction of the predetermined number of the molds 1 into the container 36. Although only one of the containers 36 is shown in FIG. 2, it is possible that a plurality of such containers 36 and their associated conveyor means and casting systems may be arranged in parallel side by side relationship so that the similar operation may be performed simultaneously.

After introducing the casting molds 1 of the predetermined number into that pressure-resisting container 36, the opposite doors 33*a* and 33*b* are closed to seal up the pressure-resisting container 36. The air release valve 23 is closed, and the air feed valve 24 is opened for causing the compressed air from its source to flow via the air conduit 26 into the air bladders 3 to thereby inflate the latter. Of course, the pressure of that compressed air is such as to be higher than that prevailing in the space 32. The individual air bladders 3 abut, when inflated, against the outer faces 37 of the casting molds 1 to clamp and fix them against movement thereof.

The cylinder 7 is actuated to bring the pad 6 into sealing engagement with the casting molds 1 and also to connect the casting and draining flexible tube 39 to the casting and discharging port 43. Simultaneously, the cylinder 5 at the side opposed to the cylinder 7 also is actuated to bring the pad 4 into sealing engagement with the casting molds 1 and to connect the in-mold pressure-reducing flexible tube 40 to the channels 2 in the mold parts of each mold. The slip discharging valve 22 is closed, and the slip feed valve 21 is opened to supply the slip typically under a pressure within the range of 0.1 to 20 kg/cm$^2$ from its source into the respective casting molds 1. The monitoring of the slip level in the casting molds 1 is performed by the level controller 10 associated with the supply reservoir 8, and the slip supply valve 21 is closed at the time when the slip in the supply reservoir 8 reaches a predetermined level.

Thereafter, the air release valve 17 is closed, and a compressed air feed valve 18 is opened to introduce the compressed air (normally under a pressure of 1 to 20 kg/cm$^2$) from its not shown source into the space 32 surrounding the casting molds 1. Since communication is being provided between the space 32 and the upper plenum of the slip supply reservoir 8, it is assured that the pressure in the space 32 is equal to that to be applied to the free surface of the slip in the auxiliary slip supply reservoir 8. Since, moreover, this slip supply reservoir 8 is in fluid communication with the mold cavity 41, the pressure on the slip free surface in the reservoir 8 is equal to that of the slip to be applied to the inner face of the casting mold 1. Accordingly, application of the common pressure to both the inner and outer faces of the casting molds 1 is achieved. Then, the water contained in the slip in the region of the molding surfaces of the casting mold 1 will exude or ooze out through the porous layers of the mold parts into the channels 2.

Next, with the air release valve 19 closed and the valve 20 opened, the pressure reducer connected to the valve 29 is actuated so that the channels 2 in the mold parts 1*a*, 1*b*, 1*c* and 1*d* may be depressurized to drain the water collected therein to the outside of the casting molds 1 through the in-mold pressure-reducing flexible tube 40. In order to promote the oozing of the water content of the slip into the channels 2, the pressure reduction of the channels 2 of the mold parts may be performed simultaneously with the feed of the compressed air into the space 32.

When the slip is cast to a layer of a predetermined thickness 42 on the molding surfaces of each casting mold 1, the slip discharging valve 22 is opened with the casting valve 21 remaining closed. Next, the motor/reduction unit 12 is actuated to rotate the roller 11 a predetermined number of turns to turn the pressure-resisting container 36 a predetermined angle about its longitudinal axis. This also causes angular displacement of the casting molds from their casting position to their inclined discharge position, in which latter position the slip remaining in the casting mold 1, i.e., the slip having failed to form the cast layer 42 may be discharged from the respective molds 1 via their draining ports 43. When the slip in the supply reservoir 8 falls down to a predetermined level, the compressed air in the space 32 will flow into the mold cavity 41 via the feed conduit 15 to promote the discharge of the slip. The slip thus discharged from within the casting mold 1 and the supply reservoir 8 flows through the valve 22 into its reservoir, in which it is reserved for further use.

When this discharge is completed, the draining valve 22 is closed. Since, at this time, the compressed air feed valve 18 is still open, the compressed air successively coming from its source will further dehydrate the cast slip layer 42. After a predetermined period of time has elapsed, the compressed air feed valve 18 is closed, and the pressureresisting container 36 is returned to its initial position by the reverse operation of the motor/reduction unit 12. Next, the air release valve 17 is opened. Then, the space 32, the supply reservoir 8 and the mold cavities 41 all in the pressure-resisting container 36 are returned to the atmospheric state by releasing the residual compressed air to the atmosphere. Next, the cylinder 7 is actuated to bring the pad 6 out of contact with the casting mold 1. Simultaneously, the cylinder 5 is also actuated to bring the pad out of contact with the casting mold 1. After doing this, the air release valve 23 is opened to release the pressure in the air bladders 3 so that the casting molds 1 may be released from its clamped and set state, thereby completing the casting cycle.

In order to transfer the molds containing the castings to different stations for further processing of the castings, the molds can be removed from the container 36 by opening the door 33*a* of the container 36. To this end, a conveyor lifter 34 is available which may be located adjacent the pressure-resisting container 36 as shown in FIG. 2.

These stations may include those for feeding the setter, removing the castings from the molds, adhering, attaching an accessory mold, boring, rinsing the mold, setting the mold for further use and so on.

Conveniently, in removal of the molds 1 from the container 36, the door 33*b* is also opened and new casting molds can be inserted into the pressure-resisting container 36 while extracting the used casting molds therefrom. Thus, the casting cycle can be performed continuously.

Figure 4:
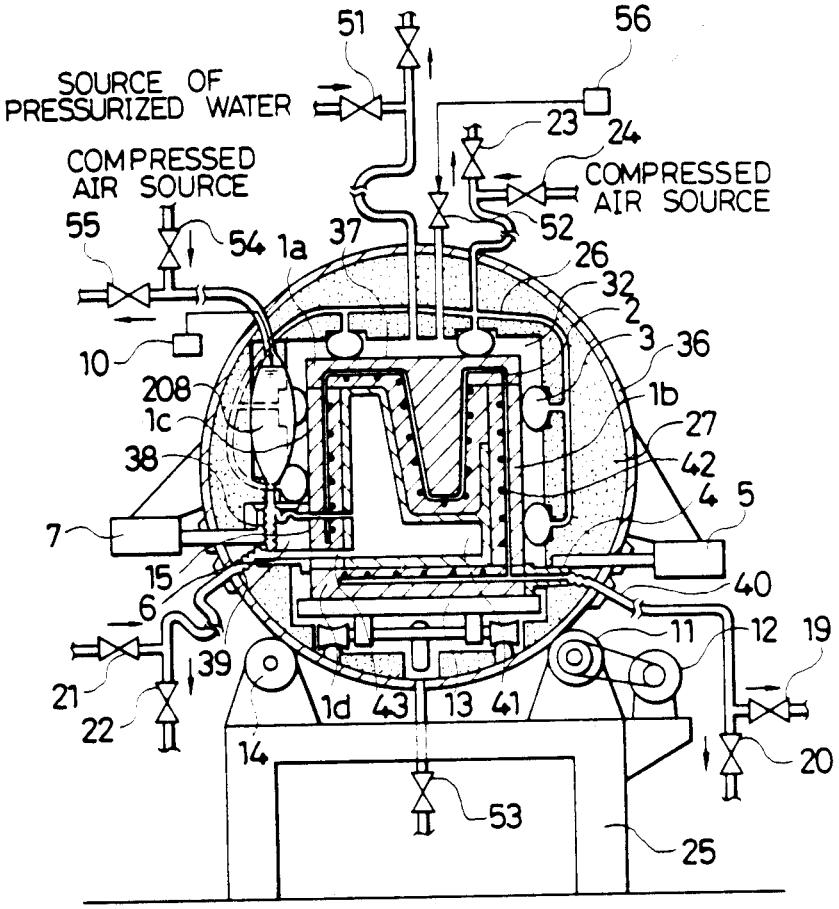
FIG. 4 is similar to FIGS. 1 and 3, showing a third embodiment of the present invention.

Turning now to FIG. 4, a casting installation of the alternative embodiment of the invention is shown which is similar to that shown in FIG. 1 mainly except that an auxiliary slip supplying reservoir 208 is provided in an extended portion of the space 32 and is adapted to be connected through a valve 54 to a compressed air source and through an air release valve 55 to the atmosphere and that a space 32 is supplied with a pressurized water through a water feed valve 51.

The slip supply reservoir 208 can be made of a resilient material such as a rubber.

A level controller 56 is provided for detecting the level of the pressurized water at which the water overflows an air release valve 52 through which the space 32 communicates with the atmosphere.

Also, a water draining valve 53 is located underneath the pressure-resisting container 36 for allowing the pressurized water which has been fed into the space 32 to discharge.

The operation of the FIG. 4 apparatus is different from that of the apparatus described with reference to FIGS. 1 and 3 in the following points.

After the slip feed valve 21 is closed, both of the air release and water draining valves 55 and 53 are closed and the pressurized water feed valve 51 is opened to introduce water under a pressure (normally 1 to 20 kg/cm$^2$) from its source (not shown) into the space 32 surrounding the casting molds 1. An air release valve 52 is closed as a level controller 56 detects the level of the pressurized water at which the water immediately overflows the valve 52. The elastic supply reservoir 208 is compressed by the pressure of the water so that the pressure in the space 32 balances the pressure of the slip in the supply reservoir 208, i.e., the pressure in the mold cavity 41.

When the slip is cast to a predetermined thickness 42 on the molding surface of each casting mold 1, the compressed air feed valve 54 is opened to introduce the compressed air (under the same pressure as of the pressurized).

Next, the slip discharge valve 22 is opened with the casting valve 21 remaining closed, and the motor/reduction unit 12 is actuated to rotate the roller 11 a predetermined number of turns to turn the pressure-resisting container 36 a predetermined angle about it's axis so that the slip remaining in the casting molds 1, i.e., the slip having failed to form the cast layer 42 may be fully discharged out from the molds 1 via the respective discharging parts 43.

When the slip in the supply reservoir 8 falls down to a predetermined level, the compressed air will flow into the mold cavity 41 via the feed conduit 15 to promote the discharging of the slip.

The slip thus discharged from the casting molds 1 and the supply reservoir 8 flows through the valve 22 into it's reservoir, in which it is reserved for further use.

When this discharge is completed, the draining valve 22 is closed.

Since, at this time, the compressed air feed valve 54 still remains open, the compressed air coming from it's source will provide for further dehydration of the cast slip layer 42.

After a predetermined period of time has elapsed, the compressed air valve 54 is closed, and the pressure-resisting container 36 is returned to it's initial state.

Next, the pressurized water feed valve 51 is closed and not only the air release valve 55 but also the water draining valve 53 and the air release valve 52 are opened to drain the water out of the space 32.

After doing this, the cylinders 7 and 5 are likewise actuated to bring the pads 6 and 4 out of contact with the casting mold 1, respectively. Then, the air release valve 23 is opened for release of the pressures in the air bladders 3 to complete the casting cycle.

As can be understood from the foregoing, the present invention employs the unique casting mold which is less heavy and bulky than in the prior art and which can withstand the same casting pressure of the slip to be fed to the mold as of the prior art. Likewise, the casting installation is light as well as highly durable. The casting efficiency can be two times as high as that of the prior art, and the cost for the facilities can be cut in half. This reduces the production cost for the casting mold to about one third as compared with the prior art.

Obviously, many modifications and variations of the present invention are possible in light of the above teachings. It is, therefore, to be understood that within the scope of the appended claims, the invention may be practiced otherwise than as specifically described.

What is claimed is:

1. A casting installation for casting slip into a ceramic product, said casting installation comprising:

a pressure container, an inner surface of said pressure container defining an opening extending through said pressure container, at least one casting mold adapted to be located in said opening of said pressure container so as to establish a space which surrounds said at least one casting mold, said casting mold being composed of a plurality of separate mold parts each having a plurality of channels therein and having its respective outer face treated to be fluid-tight, an inner molding surface of said mold parts, when assembled, being dimensioned to define a molding cavity of said at least one casting mold, said space being in communication with said molding cavity of said at least one casting mold, means for firmly clamping said at least one casting mold, means operatively connected to said channels of said mold parts for depressurizing said mold parts, a source of slip operatively connected to said molding cavity of said at least one casting mold, a source of fluid operatively connected to said space surrounding said at least one casting mold, and auxiliary slip supply reservoir means connected between said space surrounding said at least one casting mold and said molding cavity for supplying additional slip to said molding cavity.

2. A casting installation according to claim 1, wherein said clamping means comprises a plurality of separate inflatable air bladders disposed in said space so that said air bladders, when supplied with compressed air from a compressed air source, inflate and engage the outer faces of said mold parts, thereby to firmly clamp said at least one casting mold.

3. A casting installation according to claim 1, wherein said clamping means includes pneumatic or hydraulic cylinder clamp units.

4. A casting installation according to claim 1, wherein said auxiliary slip supply reservoir means includes a recess in the casting mold.

5. A casting installation according to claim 1, wherein said auxiliary slip supply reservoir means is located outside said at least one casting mold within said pressure container.

6. A casting installation according to claim 1, wherein said source of fluid comprises a compressed air source.

7. A casting installation according to claim 1, wherein said source of fluid comprises a pressurized water source.

8. A casting installation for casting slip into a ceramic product, said casting installation comprising:

a pressure container, an inner surface of said pressure container defining an opening extending through said container, at least one casting mold adapted to be located in said opening of said pressure container so as to establish a space which surrounds said at least one casting mold, said casting mold being composed of a plurality of separate mold parts each having a plurality of channels therein and having its respective outer face treated to be fluid-tight, an inner molding surface of said mold parts, when assembled, being dimensioned to define a molding cavity of said at least one casting mold, said space being in communication with said molding cavity of said at least one casting mold, means for firmly clamping said at least one casting mold, means operatively connected to said channels of said mold parts for depressurizing said mold parts, a source of slip operatively connected to said molding cavity of said at least one casting mold, and a pressurized water source operatively connected to said space surrounding said at least one casting mold.

9. A casting installation according to claim 8, wherein said clamping means comprises a plurality of separate inflatable air bladders disposed in said space so that said air bladders, when supplied with compressed air from a compressed air source, inflate and engage the outer faces of said mold parts, thereby to firmly clamp said at least one casting mold.

10. A casting installation according to claim 8, wherein said clamping means includes pneumatic or hydraulic cylinder clamp units.

11. A casting installation according to claim 8, further comprising auxiliary slip supply reservoir means connected between said space surrounding at least one casting mold and said molding cavity thereof for supplying additional slip to said molding cavity.

12. A casting installation according to claim 8, wherein said auxiliary slip supply reservoir means includes a recess in the casting mold.

13. A casting installation according to claim 8, wherein said auxiliary slip supply reservoir means is located outside said at least one casting mold within said pressure container.

14. A casting installation for casting slip into a ceramic product, said casting installation comprising:

a pressure container having a wall formed on the inner surface thereof so as to define an opening through the container, at least one porous casting mold adapted to be located in said opening of said pressure container so as to establish a space which surrounds said at least one casting mold, said at least one casting mold being composed of a plurality of separate mold parts each having a plurality of channels therein and assembled to define a molding cavity of said at least one casting mold, means for firmly clamping said at least one casting mold, means operatively connected to said channels of said mold parts for depressurizing said mold parts, means for supplying slip from a slip source into said molding cavity of said at least one casting mold, auxiliary slip supply reservoir means located outside said casting mold within said pressure container and communicating with said molding cavity for supplying additional slip into said molding cavity, said auxiliary slip supply reservoir means opening into said space surrounding said casting mold, and means for pressurizing said space surrounding said casting mold with air under pressure to equalize the pressures in said space and said molding cavity.

15. A casting installation according to claim 14, wherein said clamping means comprises a plurality of separate inflatable air bladders disposed in said space so that said air bladders, when supplied with compressed air from a compressed air source, inflate and engage the outer faces of said mold parts, to firmly clamp said at least one casting mold.

16. A casting installation according to claim 14, wherein said clamping means includes pneumatic or hydraulic cylinder clamp units located in said pressure container.

* * * * *